US006895601B2

(12) United States Patent
Park

(10) Patent No.: US 6,895,601 B2
(45) Date of Patent: May 24, 2005

(54) HEADWEAR AND SEWING METHOD THEREFOR USING RUBBER THREAD

(75) Inventor: Boo Yl Park, Seoul (KR)

(73) Assignee: Dada Corp., Seoul (KR)

( * ) Notice: Subject to any disclaimer, the term of this patent is extended or adjusted under 35 U.S.C. 154(b) by 154 days.

(21) Appl. No.: 10/382,915

(22) Filed: Mar. 7, 2003

(65) Prior Publication Data

US 2004/0172737 A1 Sep. 9, 2004

(51) Int. Cl.[7] ..... A42B 1/00
(52) U.S. Cl. ..... 2/181
(58) Field of Search ..... 2/181, 195.1–195.3, 2/175.1

(56) References Cited

U.S. PATENT DOCUMENTS 5,428,843 A * 7/1995 Clowers et al. ..... 2/195.2
5,632,046 A 5/1997 Green et al.
5,966,742 A 10/1999 Cunliffe
6,016,572 A 1/2000 Park
6,049,911 A 4/2000 Bromberg
6,347,410 B1 2/2002 Lee
2003/0131395 A1 * 7/2003 Putnam ..... 2/181
2003/0172438 A1 * 9/2003 Han et al. ..... 2/181

* cited by examiner

*Primary Examiner*—Katherine M Moran
(74) *Attorney, Agent, or Firm*—Mayer, Brown, Rowe & Maw LLP

(57) ABSTRACT

Headwear having a crown portion and a headband attached to and extending around the lower inside edge of the crown portion. The headband is preferably made of stretchable material and includes a layer of spongy material. The sewing thread used on the headband includes rubber thread and nylon stretch thread sewn together in a chain-like pattern to provide expandability and thereby increase the number of different wearer head sizes that may be accommodated by the headband. With this construction, a wide range of automatic size adjustment is obtained without imposing undue elastic pressure on the wearer.

20 Claims, 3 Drawing Sheets

FIG.5
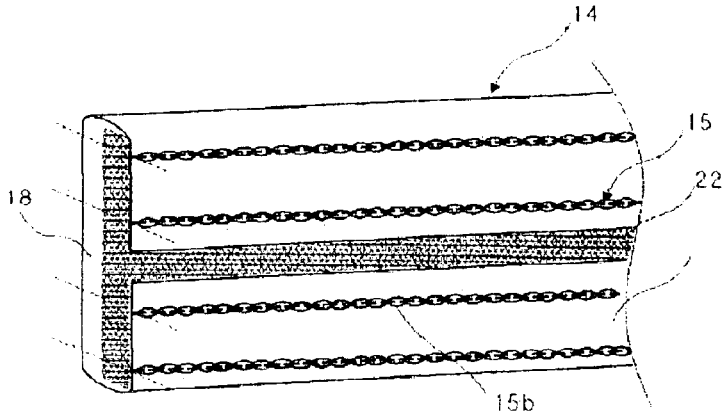
FIG.6 –PRIOR ART
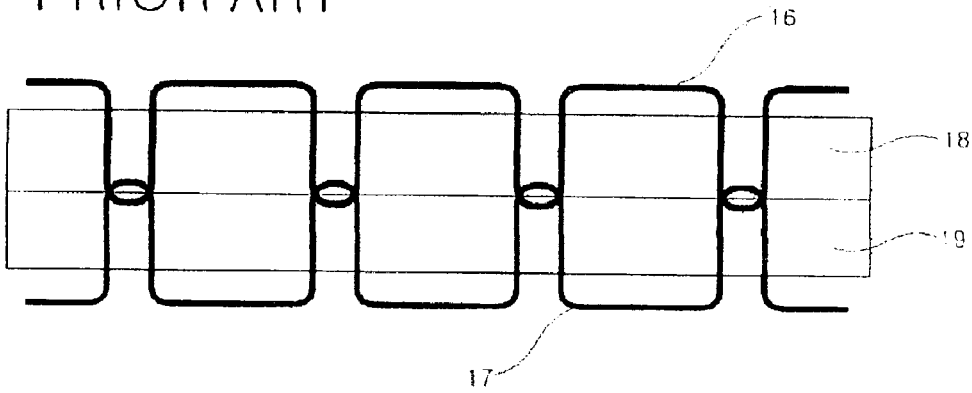
FIG.7
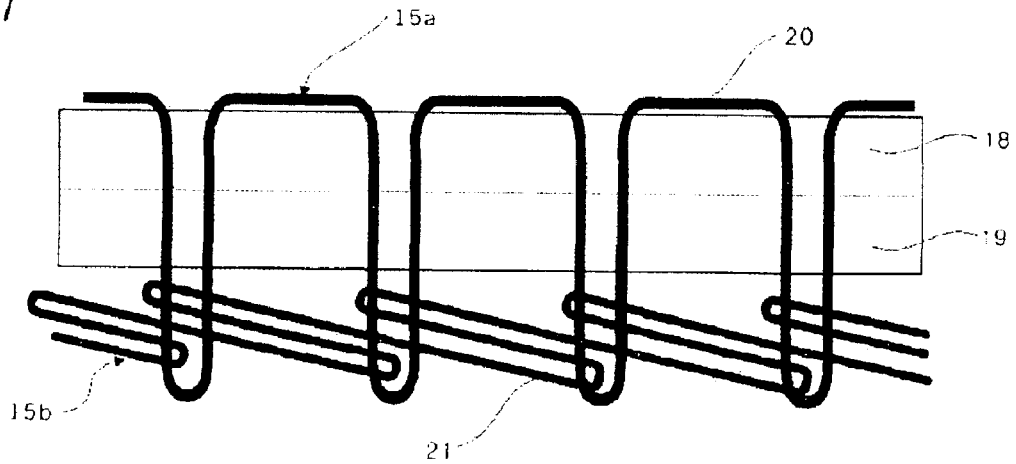

HEADWEAR AND SEWING METHOD THEREFOR USING RUBBER THREAD

BACKGROUND OF THE INVENTION

1. Field of the Invention

The present invention is related to the field of headwear and, more particularly, to headwear able to accommodate a range of head sizes, automatically fitting the wearer's head while remaining comfortable for extended use.

2. Description of the Related Art

A baseball style cap generally includes a crown main body, a visor portion that is secured to the forward edge of the crown and extends outwardly therefrom, a headband attached to the lower part of the inside of the crown, and a size controller attached to an underside of the rear of the cap. The size of the cap is adapted to fit the wearer's head using the size controller. This can be inconvenient as the wearer often must adjust the size each time the cap is worn.

To overcome this inconvenience, cap headbands have been constructed that include an elastic band made of fabric which includes spandex yarn, giving the headband size flexibility while eliminating the size controller. It has been found, however, that such a cap exerts pressure against the wearer's head which can become uncomfortable after the cap is worn for an extended period of time. In addition, the size adjustability of such a cap is limited by the lack of elasticity in the thread used to sew the headband and/or the joint between the headband and the crown.

Accordingly, a need exists for a free-size cap having a headband that can accommodate a wider range of head sizes without imposing undue pressure on the wearer so as to remain comfortable over extended time periods.

SUMMARY OF THE INVENTION

In view of the foregoing, one object of the present invention is to provide headwear with a headband that can stretch to accommodate different head sizes without a separate size controlling mechanism.

Another object of the present invention is to provide automatic size-adjusting headwear that does not exert undue pressure on the head when worn.

A further object of the present invention is to provide a cap having wider size range accommodation through the use of nylon stretch thread and rubber thread sewn in a chain-like pattern along the headband.

Yet another object of the present invention is to provide a cap in which the crown part and the headband are joined using rubber thread and nylon thread.

A still further object of the present invention is to provide a headband folded to have a tunnel-like construction at least partially enfolding an insert of spongy material for increased cushioning and moisture absorption.

In accordance with these and other objects, the present invention is directed to headwear having a crown portion and a headband attached to and extending around the lower inside edge of the crown portion. The headband is made of a stretchable material and is folded over an insert of spongy material. A visor part may also be attached to the underside of the crown portion. The sewing thread used on the headband includes rubber thread and nylon stretch thread sewn together in a chain-like pattern to provide expandability and thereby increase the number of different wearer head sizes that may be accommodated by the headband. With this construction, a wide range of automatic size adjustment is obtained without imposing undue elastic pressure on the wearer.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 5 is an inner perspective view of the headband shown in FIG. 4;

FIG. 6 is a cross-sectional view of a conventional stitching pattern; and

FIG. 7 is a cross-sectional view of the chain-like stitching pattern according to the present invention.

DETAILED DESCRIPTION OF THE PREFERRED EMBODIMENTS

Figure 1:
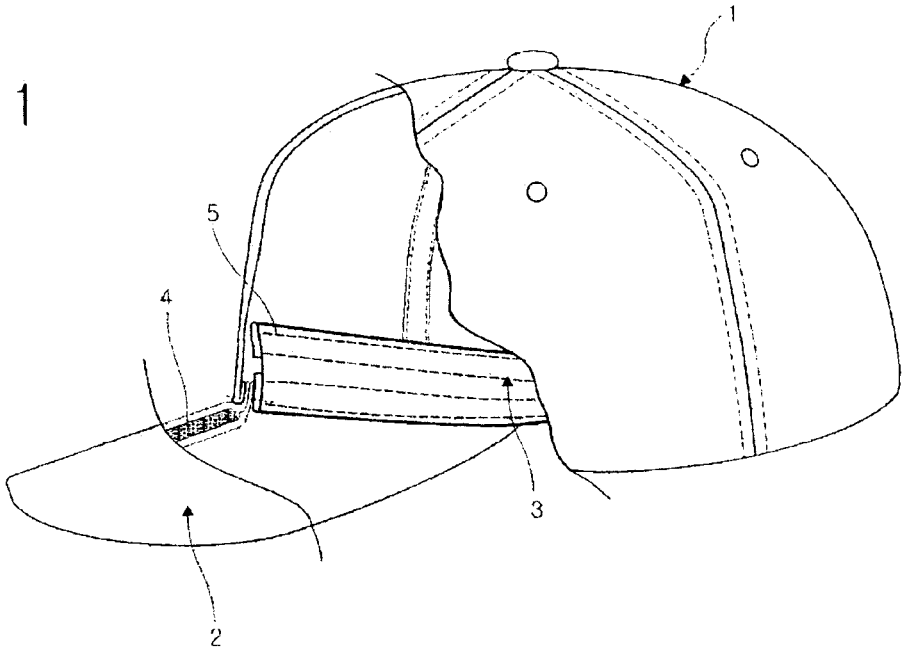
FIG. 1 is a partially sectioned view of a baseball-style cap with a headband according to the present invention.

In describing preferred embodiments of the invention illustrated in the drawings, it is to be understood that these embodiments are given by way of illustration only. It is not intended that the invention be limited in its scope to the details of construction and arrangement of components set forth in the following description or illustrated in the drawings. Also, in describing the preferred embodiments, specific terminology will be resorted to for the sake of clarity. It is to be understood that each specific term includes all technical equivalents which operate in a similar manner to accomplish a similar purpose.

The present invention is directed to headwear of various types, each having a headband sewn with rubber thread and nylon stretch thread in a chain-like pattern to provide automatic size adjustment to accommodate a wider range of head sizes and with greater comfort than is possible using prior art headwear structures and sewing methods.

According to a first embodiment as illustrated in FIG. 1, the present invention is directed to a baseball-style cap including a crown main body, generally designated by the reference numeral 1, a visor portion, generally designated by the reference numeral 2, and a headband, generally designated by the reference numeral 3. The crown part 1 is generally made of more than one piece of fabric. The visor portion 2 is secured to the forward edge of the crown main body 1, and the headband 3 is secured to the lower peripheral edge of the interior of the crown 1. The visor 2 may include a stiffening member 4 covered with the visor fabric. The headband 3 is folded to have a tunnel-like shape and is secured using a plurality of stitching lines 5, each of which is composed of rubber thread and nylon stretch thread.

In addition, the joint between the crown main body 1 and the headband 3 (not shown) is sewn using rubber thread and nylon thread, further enhancing the stretchability of the cap. The stitching of such joint may be sewn so as to be visible on the outer surface of the crown main body 1, or may be sewn so as to be visible only from the inside of the cap such that the consistency of the outer appearance of the cap is not disturbed.

Figure 2:
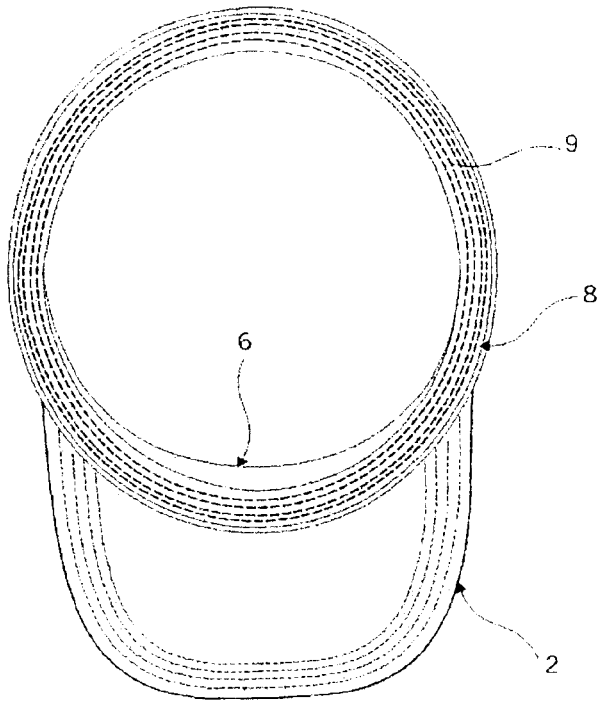
FIG. 2 is a top view of a visor cap with the headband according to the present invention.

A second embodiment of the headwear in accordance with the present invention, namely that of a visor, is shown in FIG. 2. The visor includes a crown part, generally designated by the reference numeral 6, a visor part 2 attached to the front side of the crown part 6, and a headband, generally designated by the reference numeral 8. The headband 8 is attached to the lower peripheral edge of the interior of the crown part 6. The headband 8 is folded to have a tunnel-like shape and is secured using a plurality of stitching lines 9, each of which is composed of rubber thread and nylon stretch thread. The elastic threads may be readily stretched in the direction of the periphery of the crown part 6 to accommodate various head sizes. As with the cap, the joint between the crown part 6 and the headband 8 is sewn using rubber thread and nylon thread.

Figure 3:
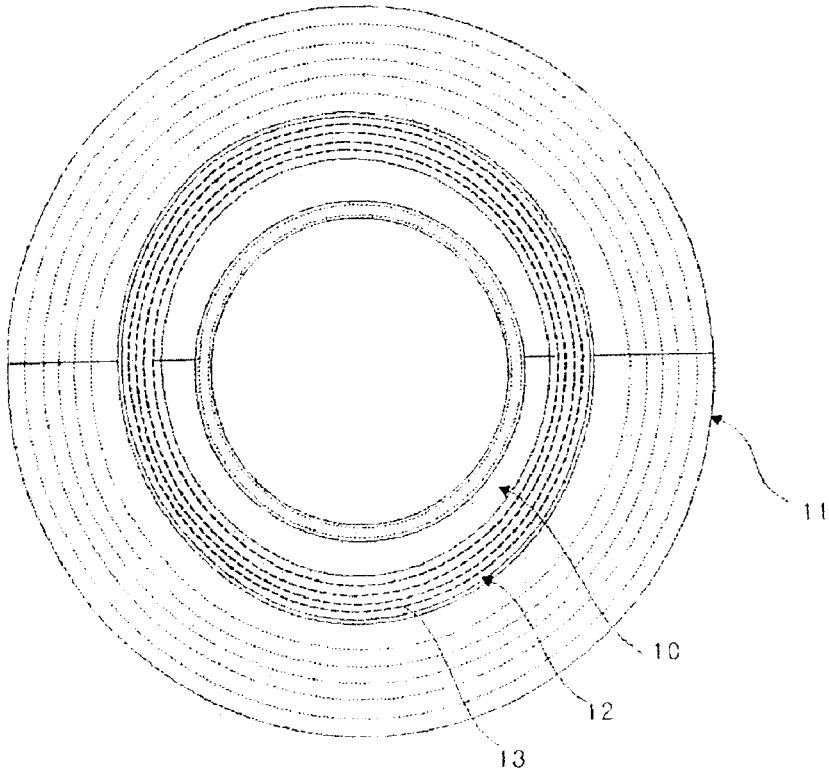
FIG. 3 is a top view of another hat, style with the headband according to the present invention.

A third embodiment of the headwear in accordance with the present invention, namely that of a brimmed hat, is shown in FIG. 3. The brimmed hat includes a crown part, generally designated by the reference numeral 10, a brim part, generally designated by the reference numeral 11, and a headband, generally designated by the reference numeral 12. The crown part 10 is generally made of more than one piece of fabric. The headband 12 and the brim part 11 are each attached to the lower peripheral edge of the interior of the crown part 10. The headband 12 is folded to have a tunnel-like shape and is secured using a plurality of stitching lines 13, each of which is composed of rubber thread and nylon stretch thread. As with the baseball-style cap and the visor, the elastic threads used to stitch the headband of the brimmed hat may be readily stretched in the direction of the periphery of the crown part 10 to accommodate various head sizes, and the joint between the crown part 10 and the headband 12 is sewn using rubber thread and nylon thread.

As shown in each of FIGS. 1–3, the respective headwear is constructed without a separate size controlling element so that, upon wearing thereof, the fabric of the headband and the stitching thereon are stretched as necessary to fit the wearer's head. The headband may be made of a textile containing no spandex yarn to limit the stretchability of such band or may, alternatively, be made of a textile which includes spandex yarn for increased size adjustability. According to a preferred embodiment, the headband is made of a stretchable material so as to provide expandability in nearly every direction.

Figure 4:
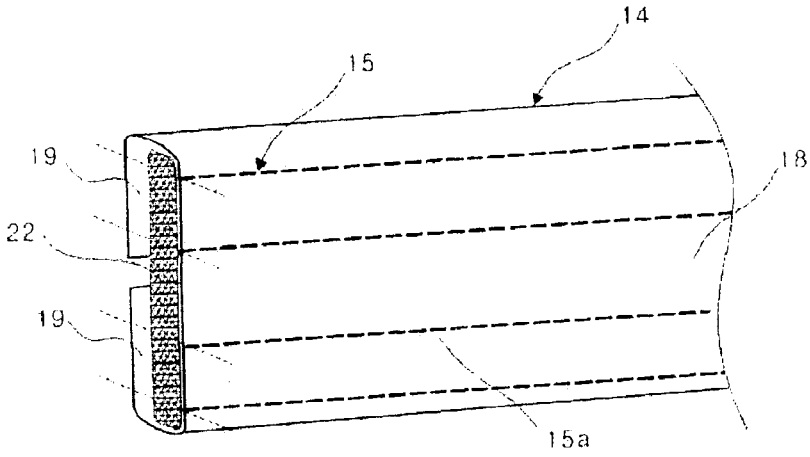
FIG. 4 is an outer perspective view of the headband having a spongy material insert and sewn with rubber and nylon stretch threads according to the present invention.

FIG. 4 illustrates a headband, generally designated by the reference numeral 14, according to a preferred embodiment of the present invention. As shown, the headband includes a length of material folded along each longitudinal edge to form a tunnel-like construction. At least partially enfolded within the headband is an insert 22 made of spongy material. The insert 22 provides increased cushioning for the wearer as well as moisture absorbency. While specified herein as a spongy material, other materials having similar cushioning and absorbency characteristics may also be used. When the headband is made of stretchable material, the resulting combination of the headband with insert is very flexible, providing enhanced wearer comfort.

The headband is sewn with rubber thread and nylon stretch thread, visible from the outer side 18, with "outer" referring to that side of the headband which directly contacts the wearer's head when the headwear bearing the headband is worn. Conversely, FIG. 5 illustrates a view of the inner side 19 of the headband 14, with "inner" referring to that side of the headband opposite the outer side 18 and contacting the inner surface of the lower edge of the, crown part of the headwear bearing the headband. The headband 14 shown in FIGS. 4 and 5 is representative of each of the headbands 3, 8, 12 depicted in the various embodiments of FIGS. 1–3.

As shown in FIGS. 4 and 5, the headband 14 preferably includes four lines of stitching, generally designated by the reference numeral 15. Each line of stitching 15 is formulated using at least two threads, which may be made of different materials, with only one of the threads being visible on one of the sides of the headband. Particularly, as shown in FIG. 4, the outer portion of the lines of stitching 15*a,* namely that portion visible on the outer side 18 of the headband 14, represents only an outer thread 20 and has an appearance like that of conventional stitching; an example of conventional stitching is shown in FIG. 6. However, according to the present invention, the inner portion of the lines of stitching 15*b,* namely that portion visible on the inner side 19 of the headband 14, shown in FIG. 5, includes both the outer thread 20 and an inner thread 21 which, as shown in greater detail in FIG. 7, are sewn together in a chain-like pattern.

According to the conventional stitching method as shown in FIG. 6, an upper thread 16 and a lower thread 17 are interwoven in a tongue-and-groove type relationship to each other through the space between the outer fabric 18 and the inner fabric 19. The resulting lines of stitching look the same on both the outer fabric 18 and inner fabric 19, with a single one of the threads 16, 17 being visible on each fabric, respectively.

According to the method of sewing with rubber thread according to the present invention, shown in FIG. 7, the outer thread 20 and the inner thread 21 are interwoven in a chain-like pattern. Starting at the outer fabric 18 (for purposes of description), the outer thread 20 goes through both the outer fabric 18 and the inner fabric 19, and then weaves down and up through a double loop of the inner thread 21, as shown, to form a chain-like pattern on the inner portion 15*b* of the lines of stitching. The outer thread 20 then goes back through the inner fabric 19 and the outer fabric 18 to form a generally linear pattern on the outer portion 15*a* of the lines of stitching 15. As shown, only the outer thread passes through the outer and inner fabric layers 18, 19 of the headband, and the outer thread 20 goes through a double loop of said inner thread 21 in between each pass through such headband fabric layers 18, 19.

According to a preferred embodiment, the outer thread 20 is nylon stretch thread and the inner thread 21 is rubber thread. It is also possible to use rubber thread for both the outer thread 20 and the inner thread 21, or to use nylon stretch thread for both threads, but best results are obtained with the nylon stretch outer thread and the rubber inner thread in accordance with the preferred embodiment.

Through the use of elastic thread elements and the chain-like pattern as described and illustrated herein, particularly in combination with stretchable headband material, the headband according to the present invention achieves good expandability, accommodating a wide range of head sizes with a high degree of comfort for the wearer.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. For example, the headband may be incorporated into hats, caps and visors of other styles. Therefore, it is not desired to limit the invention to the specific examples disclosed or the exact construction and operation shown and described. Rather, all suitable modifications and equivalents may be resorted to, falling within the scope of the invention.

What is claimed is:

1. Headwear comprising:

a crown main body; and a headband attached along a lower peripheral edge of said crown main body, said headband having a plurality of stitching lines, each of said stitching lines formed from an inner thread and an outer thread interwoven in a chain-like pattern, each of said inner thread and said outer thread having elasticity.

2. The headwear as set forth in claim 1, wherein said crown main body and said headband are sewn together using nylon thread and rubber thread.

3. The headwear as set forth in claim 2, wherein said outer thread is nylon stretch thread and said inner thread is rubber thread.

4. The headwear as set forth in claim 1, wherein said outer thread is nylon stretch thread and said inner thread is rubber thread.

5. The headwear as set forth in claim 1, wherein said headband is made of textile containing no spandex yarn.

6. The headwear as set forth in claim 1, wherein said crown main body is made of more than one piece of fabric including spandex yarn.

7. The headwear as set forth in claim 1, wherein said crown main body is made of more than one piece of fabric containing no spandex yarn.

8. The headwear as set forth in claim 3, wherein said plurality of stitching lines are sewn such that on one side of said headband only said outer thread is visible.

9. The headwear as set forth in claim 8, wherein only said outer thread passes through said headband.

10. The headwear as set forth in claim 8, wherein both said inner thread and said outer thread, interwoven in said chain-like pattern, are visible on a side of said headband opposite said one side.

11. The headwear as set forth in claim 9, wherein said inner is interwoven with said outer thread in said chain-like pattern exclusively on a side of said headband opposite said one side.

12. The headwear as set forth in claim 1, wherein said headband is made of stretchable material and further includes an insert of spongy material are least partially enfolded within said headband.

13. Headwear comprising:

a crown main-body;

a visor portion secured to a peripheral edge of said crown main body and extending outwardly therefrom; and a headband attached along said lower peripheral edge of said crown main body, said headband folded to have a tunnel-like construction secured by a plurality of stitching lines, each of said stitching lines formed from a rubber thread and a nylon stretch thread interwoven in a chain-like pattern, said headband including an insert of absorbent material at least partially enfolded by said headband folds and secured by said plurality of stitching lines.

14. The headwear as set forth in claim 13, wherein a joint between said crown main body and said headband is sewn using nylon thread and rubber thread.

15. The headwear as set forth in claim 14, wherein said joint is sewn so that a stitch line thereof is visible on an outer surface of said crown main body.

16. The headwear as set forth in claim 14, wherein said joint is sewn so that a stitch line thereof is not visible on an outer surface of said crown main body.

17. The headwear as set forth in claim 13, wherein said plurality of stitching lines are sewn such that on one side of said headband only said nylon stretch thread is visible.

18. The headwear as set forth in claim 13, wherein only said nylon stretch thread passes through said headband.

19. The headwear as set forth in claim 18, wherein both said nylon stretch thread and said rubber thread, interwoven in said chain-like pattern, are visible on a side of said headband opposite said one side.

20. The headwear as set forth in claim 19, wherein said nylon stretch thread passes through a double loop of said rubber stretch thread on said side opposite said one side in between each pass through said headband.

* * * * *